US006296220B1

(12) United States Patent
Texidor

(10) Patent No.: US 6,296,220 B1
(45) Date of Patent: Oct. 2, 2001

(54) MILLENNIUM OBJECT

(76) Inventor: Genaro Texidor, 2606 Hexe Ct., Augusta, GA (US) 30906

( * ) Notice: Subject to any disclaimer, the term of this patent is extended or adjusted under 35 U.S.C. 154(b) by 0 days.

(21) Appl. No.: 09/334,735

(22) Filed: Jun. 17, 1999

(51) Int. Cl.[7] ..... A47B 91/00
(52) U.S. Cl. ..... 248/346.01; 248/175; 248/908
(58) Field of Search ..... 248/908, 915, 248/175, 346.01

(56) References Cited

U.S. PATENT DOCUMENTS

| | | | |
|---|---|---|---|
| D. 70,306 | | 6/1926 | Warren . |
| D. 99,147 | | 3/1936 | Tweed . |
| D. 198,856 | | 8/1964 | Rossi . |
| D. 258,901 | | 4/1981 | Keyworth . |
| D. 267,665 | | 1/1983 | Robinson . |
| D. 296,917 | | 7/1988 | Kotler . |
| D. 298,960 | | 12/1988 | Vela . |
| D. 304,356 | | 10/1989 | Potter et al. . |
| D. 306,326 | | 2/1990 | Fiust . |
| D. 319,478 | | 8/1991 | Ventriglia . |
| D. 324,401 | | 3/1992 | Pruitt . |
| D. 361,106 | | 8/1995 | Alberico . |
| D. 375,219 | * | 11/1996 | Selent ..... D6/538 |
| D. 393,024 | | 3/1998 | Allen et al. . |
| D. 402,714 | | 12/1998 | Angelora et al. . |
| 3,289,990 | * | 12/1966 | Grantham ..... 248/309.4 |
| 3,839,821 | * | 10/1974 | Forsman ..... 248/28 |
| 4,563,373 | * | 1/1986 | Barnett ..... 248/908 X |
| 4,579,538 | * | 4/1986 | Bass et al. ..... 446/107 |

* cited by examiner

*Primary Examiner*—Ramon O. Ramirez
(74) *Attorney, Agent, or Firm*—Bernstein & Associates, P.C.; Jason A. Bernstein

(57) ABSTRACT

A millennium object that embodies the nature of a "millennium": the simultaneous ability to look forwards to a new era and backwards to the past. The object has two eyelike objects ("oculi"), each with two opposing "eyes" that see in two directions simultaneously. The oculi are attached to items such as desk accessories (letter holders, pen holders, calendars, etc.), jewelry (tie tacks, pins, earrings, pendants, etc.), accessories (key holders, belt buckles), clothing (caps, visors, T-shirts), dolls or figurines, or indeed any other desired item for commemorating the millennium. The oculi may be stationary or movable, of any desired color or shape. In one embodiment of the invention, a signal generator emits a perceptible signal whenever the oculi move.

11 Claims, 4 Drawing Sheets

MILLENNIUM OBJECT

BACKGROUND OF THE INVENTION

1. Field of the Invention:

The present invention relates to a millennium object. In particular, the present invention relates to an object that exemplifies the essence of a millennium or other important date: the ability to simultaneously look forwards to the future and backwards to the past era.

2. Discussion of Background:

The coming millennium has generated interest in anything that is (or could be) associated with "the year 2000." A particularly widespread concern centers around the "Y2K" computer problem that results from the prevalence of two-digit date coding in computer software. Experts believe that older computers may malfunction when turning over from Dec. 31, 1998 to Jan. 1, 1999, which could adversely affect transportation, telephone, banking, and other systems that are highly computer-dependent.

Whether or not there is a "millennium" at all depends on the particular selection of dating system: the upcoming "year 2000" is a millennium only in the so-called "AD" (Anno Domini) or "CE" (Christian Era) dating system. Even in this system, there is some confusion about whether the "millennium" should be celebrated in the year 2000 or the year 2001, or (in some circles) whether the Gregorian or Julian calendar is the more valid.

No matter what the frame of reference, however, a millennium occurs only once in a thousand years. Thus, the year 2000 (or 2001) will be widely celebrated as a millennium in regions that use the Western calendar. Others regions have other millennia, past or yet to come, which are equally important in their own contexts.

A variety of Y2K-oriented products and services are available to consumers, including computer hardware and software, games, novelties, food products, survival kits, candles, computer-related consulting services, and commemorative items. Well over a hundred applications for registration of trademarks that include the term "Y2K" have been filed in the U.S. alone. Despite this great interest in millennium-related products, there is no known product that exemplifies the fundamental nature of a "millennium": being positioned at the beginning of a new era, looking backwards to the past and forwards to the future.

Many—perhaps most—people are collectors. Some people collect antiques or works of art; others collect stamps, trading cards, election campaign buttons, commemorative items associated with newsworthy events, or memorabilia associated with a favorite sport. No doubt some people will amass collections of "year 2000" items. There is an almost-incredible variety of useful and ornamental objects available to consumers; many of these are used for commemoratives, collectibles, and souvenirs. By way of example, useful devices that incorporate decorative, animal-like figures are shown by Stursberg (U.S. Pat. No. Des. 187,869), Dearling, et al. (U.S. Pat. No. Des. 182,168), Malsed (U.S. Pat. No. Des. 179,949), Haskell (U.S. Pat. No. Des. 177,175), Zipkin (U.S. Pat. No. Des. 172,528), and Lee (U.S. Pat. No. Des. 170,504). A variety of curved ornamental designs are shown by Welch (U.S. Pat. No. 4,545,489 and U.S. Pat. No. Des. 281,335), Arkin (U.S. Pat. No. Des. 26,320), Saniugarte, et al. (U.S. Pat. No. Des. 404,074), Ford (U.S. Pat. No. Des. 404,972), and Garrett (U.S. Pat. No. Des. 180,143). Designs that include eye-like and face-like objects include those disclosed by Coulter (U.S. Pat. No. Des. 342,695), Haenelt (U.S. Pat. No. Des. 229,947), Maxwell (U.S. Pat. No. Des. 213,212), Williams (U.S. Pat. No. Des. 201,490), and Sly (U.S. Pat. No. Des. 181,497). Galef (U.S. Pat. No. Des. 178,356) shows a letter holder with two rounded tips (U.S. Pat. No. Des. 178,356) and a cat-like figure with two flat "eyes" (U.S. Pat. No. Des. 174,255). Stursberg's figurine (U.S. Pat. No. Des. 187,869) has antennae with ball-like tips.

Special-edition toys such as dolls are a favorite collectible item. Dolls are usually at least somewhat representative of the human form, whereas others are alien in appearance. These include dolls with antennae and flipper-like appendages, such as those shown by Angelora, et al. (U.S. Pat. No. Des. 402,714), Allen, et al. (U.S. Pat. No. Des. 393,024), Ventriglia, et al. (U.S. Pat. No. Des. 319,478), Alberico (U.S. Pat. No. Des. 361,106), Pruitt (U.S. Pat. No. Des. 324,401), Potter, et al. (U.S. Pat. No. Des. 304,356), Fiust (U.S. Pat. No. Des. 306,326), Rossi (U.S. Pat. No. Des. 198,856), Robinson (U.S. Pat. No. Des. 267,665), and Vela (U.S. Pat. No. Des. 298,960. Some have only a single "eye," for example, the Robinson and Keyworth (U.S. Pat. No. Des. 258,901) figures.

None of these designs evokes the basic concept of a "millennium," whether the millennium in question is the upcoming "Y2K" or the thousand-year anniversary of some other important date. There is no known design that exemplifies the unique position of a person who is celebrating a millennium-type event: someone or something that is located on the cusp of two eras, simultaneously looking backwards to the past and forwards to the future.

SUMMARY OF THE INVENTION

According to its major aspects and broadly stated, the present invention is a millennium object, that is, an object that embodies the nature of a "millennium" of any kind: the simultaneous ability to look forwards to a new era and backwards to the past. This double vision is made possible by a device herein termed an "oculus," that is, an oculate, eye-like object with dual "eyes" that "see" in both directions simultaneously. The oculus is attached to items such as sculptures, desk accessories, wearable items such as jewelry or clothing, dolls or figurines, or other items.

A major feature of the present invention is the oculus with dual-vision "eyes" that see in two directions at once. That is, the oculus includes a first "eye" that is oriented in one direction, and a second "eye" oriented in a diametrically opposed direction. The two directions, which are preferably about 180 degrees apart, symbolize the cusp defined by the end of the present millennium and the beginning of the next at the year 2000 (or 2001). The two directions may also symbolize any major anniversary, including but not necessarily limited to thousand-year anniversaries. Alternatively, the two directions may symbolize the ability to simultaneously view two diametrically opposing positions (night and day, good and evil, left and right, and so forth). The oculi may be stationary or movable, of any desired color or shape. In one embodiment of the invention, a noise generator sounds a tone whenever an oculus moves.

An important feature of the present invention is its versatility. The invention may include any of a variety of useful items such as desk accessories (letter holders, pen holders, calendars, etc.), jewelry (tie tacks, pins, earrings, pendants, etc.), accessories (key holders, belt buckles), and clothing (caps, visors, T-shirts). It may be embodied in a doll or figurine, or indeed any other desired item for commemorating a millennium.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1A:
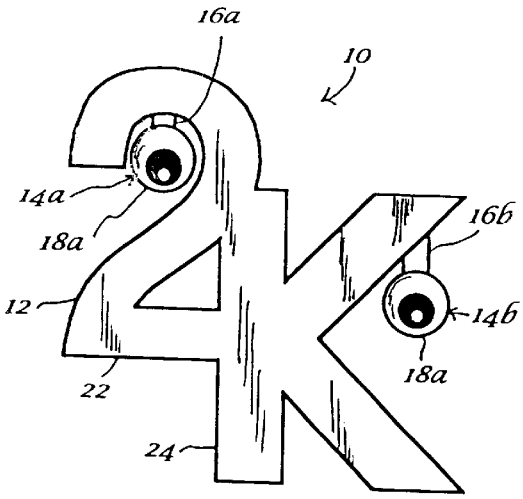
FIGS. 1A and 1B are front and rear plan views of a millennium object according to a preferred embodiment of the present invention.

In the following detailed description of the invention, reference numerals are used to identify structural elements, portions of elements, surfaces or areas in the drawings, as such elements, portions, surfaces or areas may be further described or explained by the entire written specification. For consistency, whenever the same numeral is used in different drawings, it indicates the same element, portion, surface or area as when first used. Unless otherwise indicated, the drawings are intended to be read together with the specification, and are to be considered a portion of the entire written description of this invention as required by 35 U.S.C. §112. As used herein, the terms "horizontal," "vertical," "left," "right," "up," "down," as well as adjectival and adverbial derivatives thereof, refer to the relative orientation of the illustrated structure as the particular drawing figure faces the reader.

Figure 1B:
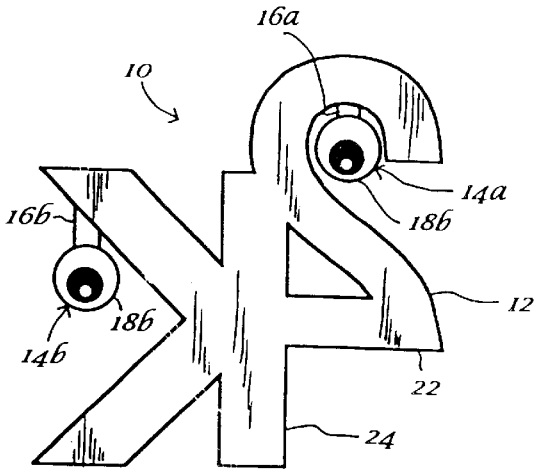
Figure 2:
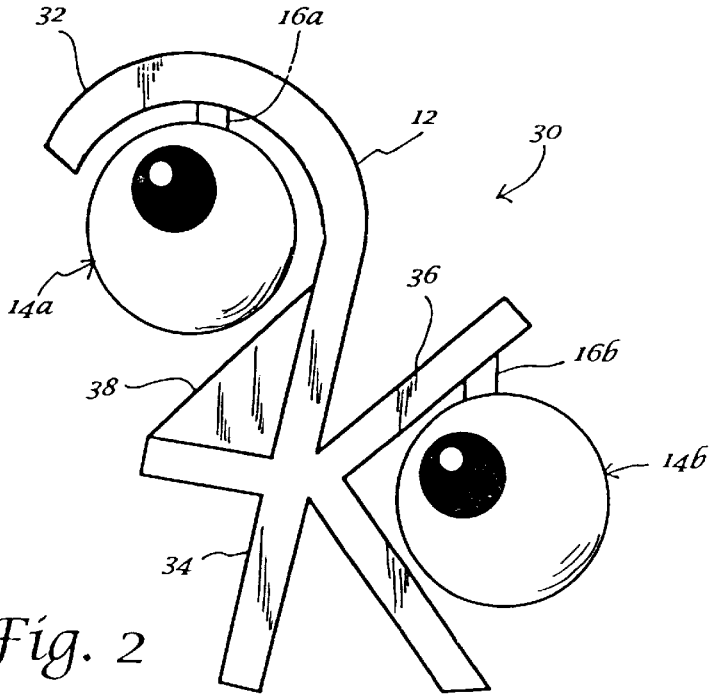
FIG. 2 is a front plan view of another millennium object according to the invention.

Referring now to FIGS. 1A and 1B, there is shown a millennium object 10 according to one preferred embodiment of the present invention. Object 10 includes base portion 12 with two "oculi" 14*a,* 14*b* attached thereto by connectors such as rods 16*a,* 16*b*. The term "oculus" (plural, "oculi") as used herein refers to an oculate, "eye-like" object that "sees" in two directions simultaneously, preferably two diametrically opposing directions as indicated in FIGS. 1A and 1B. Object 10 has two such oculi 14*a,* 14*b,* each of which can "see" in two directions simultaneously: right and left, up and down, in and out, or forwards and backwards. Preferably, each of oculi 14*a,* 14*b* has a first "eye" 18*a* facing in one direction, and a second "eye" 18*b* facing in a different direction. These two directions may be approximately 180° apart as shown, or may be separated by some other angle if desired. In a preferred embodiment of the invention, oculi 14*a,* 14*b* are pivotably or rotatably attached to rods 16*a,* 16*b*.

Oculi 14*a,* 14*b* represent the dual vision or dual perspective that occurs at a millennium event (either the upcoming "Y2K" or some other important date): the capability of simultaneously looking forwards to the future and backwards to the past. Oculi 14*a,* 14*b* may also represent the capability of simultaneously viewing two opposing directions or viewpoints, such as right and left, up and down, day and night, good and evil, and so forth. If desired, oculi 14*a,* 14*b* may have three or even more eyes such as 18*a,* 18*b*.

Millennium object 10 may be made of any suitable materials: metal, plastic, wood, composites, and so forth. The object may take the form of a free-standing sculpture as shown in FIGS. 1A and 1B; alternatively, object 10 may be attached to an item such as a desk accessory, wearable item, jewelry, and so forth.

The configuration of object 10 may be varied without departing from the spirit of the present invention. By way of example, base 12 of object 10 includes two letters 22 ("2") and 24 ("K"), while another millennium object 30 according to the invention has a base that includes stylized letters 32 ("2"), 34 ("Y") and 36 ("K"). If desired, object 30 may also include an inset 38, of glass, stained glass, or any suitable, esthetically pleasing material. Other variations which will be evident to those of ordinary skill in the art may commemorate other dates of interest.

Figure 3A:
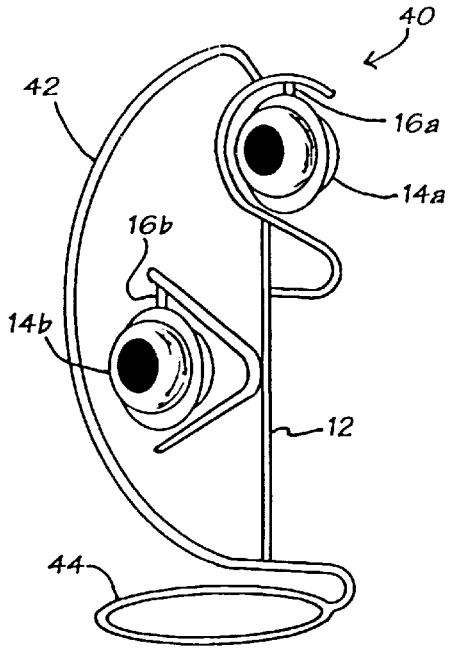
FIGS. 3A–3C show additional millennium objects according to the invention.
Figure 3B:
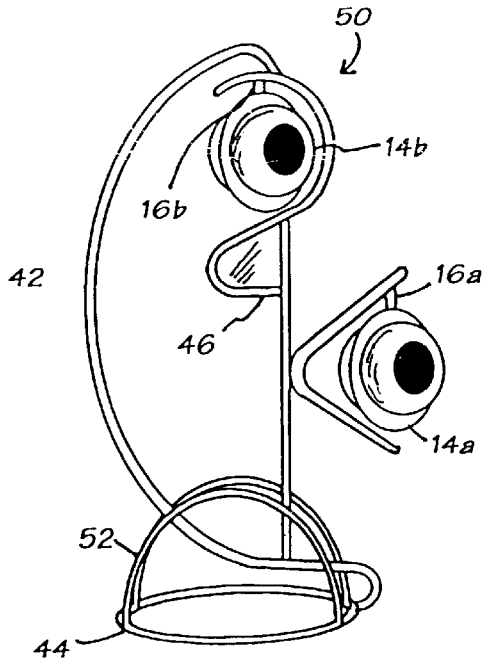
Figure 3C:
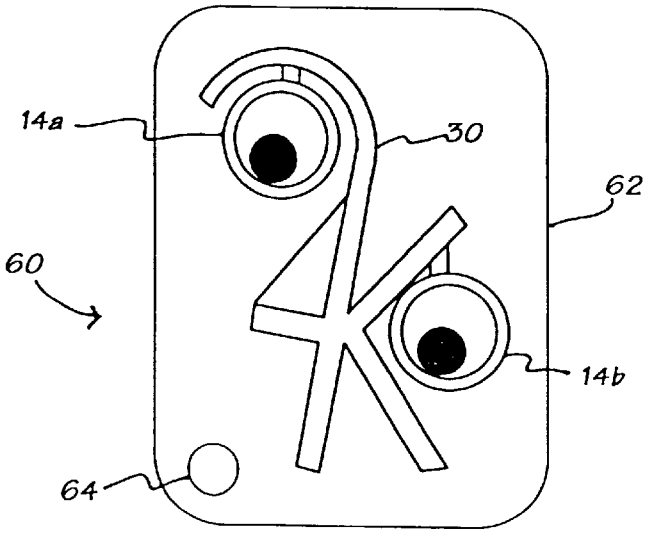

FIGS. 3A–3C illustrate additional embodiments of the present invention. A free-standing wire sculpture 40 (FIG. 3A) has two oculi 14*a,* 14*b* as described above, and a base portion 12 that includes the stylized letters "Y," "2" and "K" (somewhat similar in appearance to above-described object 30). In this embodiment, base portion 12 includes an arc 42 and a support 44. Another wire sculpture 50 (FIG. 3B) includes a letter holder 52 attached to support 44 and an inset 46. Oculi 14*a,* 14*b* may be directly attached to base portion 12, but preferably are pivotably or rotatably attached to rods 16*a,* 16*b*.

Still another millennium object 60 includes an object 30 attached to a base 62, which may take the form of a pin, tie tack, cuff link, charm, key holder, and the like. A through-hole 64 may be provided for attaching a key chain, key ring, necklace, or the like.

Figure 4A:
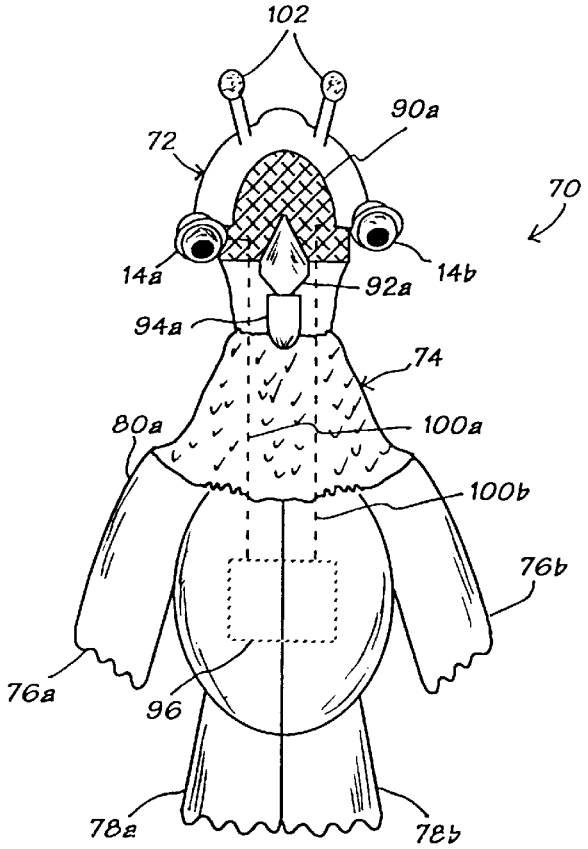
FIGS. 4A and 4B are front and rear views of a millennium doll according to the invention.
Figure 4B:
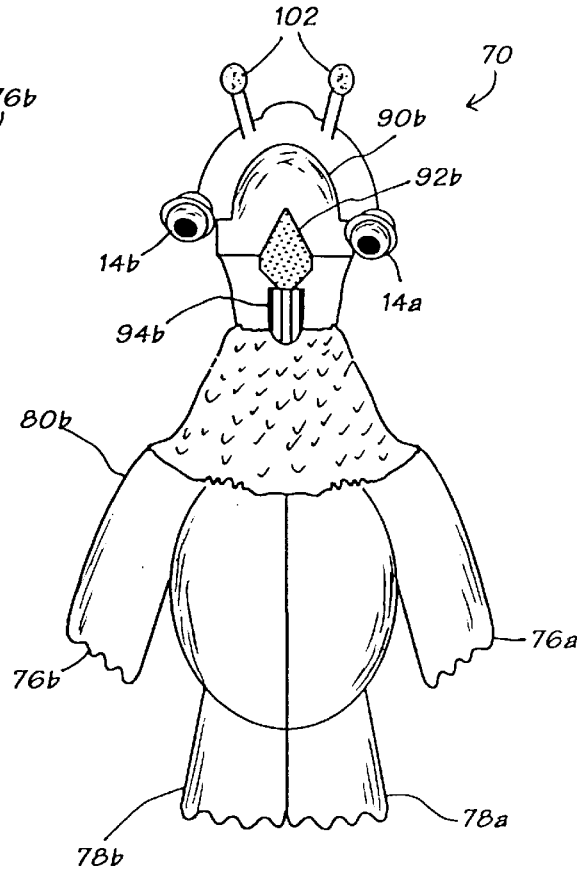

A millennium object according to the invention may be embodied in the form of a child's toy or other stuffed figure, such as a doll 70 shown in FIGS. 4A and 4B. Doll 70 has a head 72, a body 74, and flipper-like appendages 76*a,* 76*b* and 78*a,* 78*b*. A pair of oculi 14*a,* 14*b* are attached to head 72, one on each side of the head, so that doll 70 has the forwards/backwards "seeing" capability described above.

To further embody the occurrence of a "millennium," doll 70 has at least one body portion that is different on a front side 80*a* and a rear side 80*b*. For example, a forehead portion 90*a* on front side 80*a* may be a different color or texture from a corresponding forehead portion 90*b* on rear side 80*b*. Alternatively, a nose portion 92*a* may differ from corresponding nose portion 92*b,* or a chin portion 94*a* from corresponding chin portion 94*b*. (The shading of portions 90*a,* 90*b,* 92*a,* 92*b,* 94*a,* 94*b* is intended to show that these portions differ in appearance and/or texture on front side 80*a* and rear side 80*b.)*

Oculi 14*a,* 14*b* on doll 70 are preferably movable, for example, rotatable, pivotable, articulatable, or otherwise manipulable by the user. If desired, a signal generator 96 may be incorporated into doll 70, operably connected to oculi 14*a,* 14*b* by cables 100*a,* 100*b* so that generator 96 emits an audible signal whenever the oculi move. Alternatively, generator 96 may be replaced by any convenient device that emits a visible or tactile signal corresponding to movement of oculi 14*a,* 14*b*. Generator 96 may be the type of push-button noisemaker found in many children's toys. If desired, generator 96 may be user-programmable to emit a selected signal, such as a "millennium"-related message or a personal message. Generator 96, if present, is preferably battery-powered.

Figure 5:
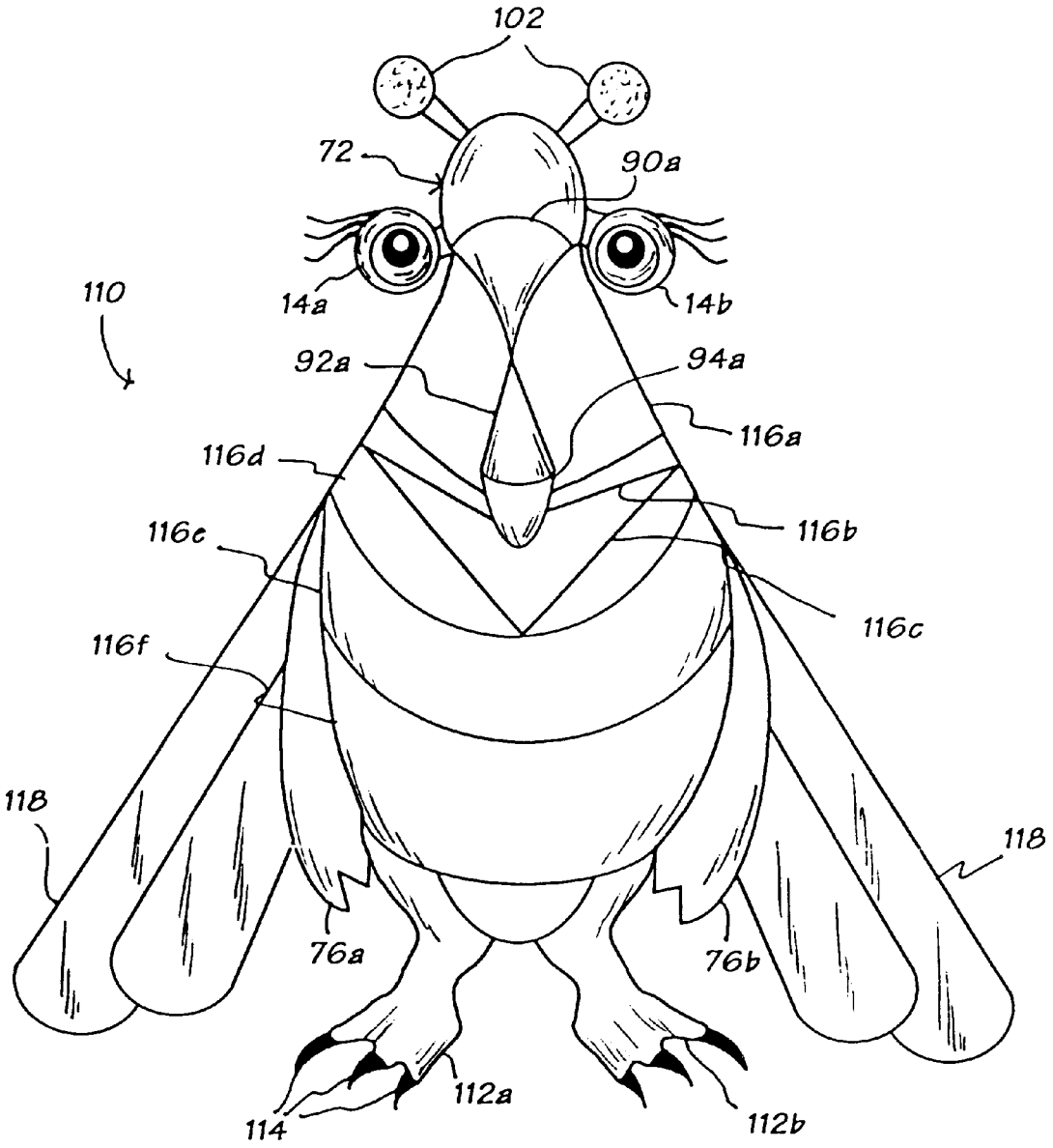
FIG. 5 is a front view of another millennium doll according to the invention.

Doll 70 may be of any desired size and shape, with any desired number of appendages in the form of "arms," "legs," "wings," "antennae" (such as antennae 102) and the like. For example, another doll 110 according to the present invention has a head 72 with portions 90*a,* 92*a,* 94*a* and a pair of oculi 14*a,* 14*b* as described above (FIG. 5). Instead of appendages 78*a,* 78*b,* doll 110 has a pair of legs 112*a,* 112*b,* each with a plurality of talons 114.

Doll 110 has a body with a plurality of portions 116*a,* 116*b,* 116*c,* . . . , each of which differs from an adjacent portion 116*a,* 116*b,* 116*c,* . . . in at least one of the following properties: color, shape, material, texture, decoration. As for above-described doll 70, at least one of portions 90*a,* 92*a,* 94*a,* 116*a,* 116*b,* 116*c,* . . . on the front of doll 110 differs in some combination of color, shape, material, texture, and decoration from the corresponding portion on the rear of doll 110. If desired, doll 110 may include a signal generator 96, as well as other features (antennae 102, wings 118, etc.).

Dolls 70, 110 may be made of virtually any materials commonly used for such items, using any desired fabrics, colors, textures, decorations (buttons, braid, embroidery, etc.) and so forth. Oculi 14*a,* 14*b* of any of above-described objects 10, 40, 50, 60, 70, 110 may include user-operable, battery-powered LEDs, light bulbs, noise generators, or other devices that emit visible, tactile, or audible signals.

With respect to the above description of the invention, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing description is considered as illustrative only of the principles of the invention. Further, since numerous modifications and changes will readily occur to those skilled in the art, it is not desired to limit the invention to the exact construction and operation shown and described; and accordingly, all suitable modifications and equivalents may be resorted to, falling within the scope of the invention. Thus, it will be apparent to those skilled in the art that many changes and substitutions can be made to the preferred embodiment herein described without departing from the spirit and scope of the present invention as defined by the appended claims.

What is claimed is:

1. A device, comprising:

a base portion; and at least one oculus attached to said base portion, said oculus having a first eye oriented in a first direction, and a second eye oriented in a second direction, said second direction being opposed to said first direction, wherein each of said eyes has a front and a rear, and wherein a rear of said first eye engages a rear of said second eye so that said first eye and said second eye are diametrically opposed.

2. A device, comprising:

a base portion; and two spaced-apart oculi attached to said base portion, each of said oculi having a first eye having a front and a rear, and a second eye having a front and a rear, said rear of said first eye attached to said rear of said second eye so that said first and second eyes face in diametrically opposing directions.

3. The device as recited in claim 2, wherein said base portion further comprises a desk accessory, an item of clothing, a jewelry item, a doll, a sculpture, or a wearable accessory item.

4. The device as recited in claim 2, wherein said base portion has a front and a rear, and wherein at least a portion of said front is a different color from a corresponding portion of said rear.

5. The device as recited in claim 2, wherein said base portion has a front and a rear, and wherein at least a portion of said front has a different texture from a corresponding portion of said rear.

6. The device as recited in claim 2, wherein said base portion has a front face and a rear face, and wherein at least a portion of said front face is a different color from a corresponding portion of said rear face.

7. The device as recited in claim 2, wherein said oculi are movably connected to said base portion.

8. The device as recited in claim 2, further comprising a signal generator operatively connected to said oculi, said signal generator operable to generate an audible signal whenever at least one of said oculi moves.

9. The device as recited in claim 2, further comprising user-operable means for moving said oculi.

10. The device in claim 2, further comprising; user-operable means for moving said oculi; and a signal generator operatively connected to said oculi, said signal generator emitting an audible signal whenever at least one of said oculi moves.

11. The device as recited in claim 2, further comprising a user-programmable signal generator operatively connected to said oculi, said signal generator operable to generate a perceptible signal whenever at least one of said oculi moves.

* * * * *